US009643242B2

(12) United States Patent
Zhang et al.

(10) Patent No.: US 9,643,242 B2
(45) Date of Patent: May 9, 2017

(54) BACK-UP ROLL DEVICE AND METHOD FOR CONDUCTING CORNER DEFORMATION ON CHAMFERED CONTINUOUS CASTING SLAB

(71) Applicant: Central Iron and Steel Research Institute, Beijing (CN)

(72) Inventors: Hui Zhang, Beijing (CN); Minglin Wang, Beijing (CN); Xiuqin Ji, Beijing (CN); Mei Wang, Beijing (CN); Hongbiao Tao, Beijing (CN); Yicheng Wang, Beijing (CN); Yong Gan, Beijing (CN)

(73) Assignee: Central Iron and Steel Research Institute, Beijing (CN)

( * ) Notice: Subject to any disclaimer, the term of this patent is extended or adjusted under 35 U.S.C. 154(b) by 74 days.

(21) Appl. No.: 14/657,939

(22) Filed: Mar. 13, 2015

(65) Prior Publication Data

US 2015/0258604 A1 Sep. 17, 2015

(30) Foreign Application Priority Data

Mar. 13, 2014 (CN) ..... 2014 1 0092626

(51) Int. Cl.
*B22D 11/06* (2006.01)
*B22D 11/12* (2006.01)
(Continued)

(52) U.S. Cl.
CPC ..... *B22D 11/0651* (2013.01); *B22D 11/0628* (2013.01); *B22D 11/1206* (2013.01);
(Continued)

(58) Field of Classification Search
CPC ..... B22D 11/128; B22D 11/1287; B22D 11/1206; B22D 11/0628; B22D 11/0651
(Continued)

(56) References Cited

U.S. PATENT DOCUMENTS 4,513,491 A * 4/1985 Bohnenkamp ..... B21B 1/026 164/476
2005/0150631 A1 7/2005 Bergmans et al.

FOREIGN PATENT DOCUMENTS

CN 202447619 U 9/2012
CN 203725727 U 7/2014
(Continued)

OTHER PUBLICATIONS

Office Action mailed May 29, 2015 in corresponding CN Application No. 201410092626.X, and English translation thereof. 7 pages.
(Continued)

*Primary Examiner* — Kevin P Kerns
(74) *Attorney, Agent, or Firm* — Muncy, Geissler, Olds & Lowe, P.C.

(57) ABSTRACT

A back-up roll device and method for conducting corner deformation on a chamfered continuous casting slab. The back-up roll device includes back-up rolls with α-angle bevels, movable bearing seats, bearing seat moving rails, bearing seat motion holding mechanisms and inner arc or outer arc frames of a casting machine. The back-up rolls are arranged on the inner and/or outer arc frames of the horizontal segment of the casting machine. Support surfaces of the back-up rolls make contact with and squeeze smaller obtuse angles adjacent to the wide face of the inner or outer arc on the chamfered continuous casting slab, and therefore each smaller obtuse angle is squeezed into two larger obtuse angles. The back-up roll device and method for conducting corner deformation on the chamfered casting slab can achieve the purposes of eliminating edge slivers.

8 Claims, 5 Drawing Sheets

(51) Int. Cl.
*B22D 11/128* (2006.01)
*B22D 25/02* (2006.01)

(52) U.S. Cl.
CPC ..... *B22D 11/128* (2013.01); *B22D 11/1287* (2013.01); *B22D 25/02* (2013.01)

(58) Field of Classification Search
USPC ..... 164/427, 479, 442, 448
See application file for complete search history.

(56) References Cited

FOREIGN PATENT DOCUMENTS

| | | | | | |
|---|---|---|---|---|---|
| EP | 0659503 | A2 | | 6/1995 | |
| JP | 63-215351 | A | * | 9/1988 | ..... B22D 11/128 |

OTHER PUBLICATIONS

Office Action mailed Jul. 22, 2015 in corresponding CN Application No. 201410092626.X, and English translation thereof. 8 pages.
Search Report completed Aug. 31, 2015 in corresponding CN Application No. 201410092626.X, and English translation thereof. 4 pages.
Decision to Grant Patent (Notification for Grant Patent Right of Invention) mailed Oct. 15, 2015 in corresponding CN Application No. 201410092626.X, and English translation thereof. 2 pages.

* cited by examiner

BACK-UP ROLL DEVICE AND METHOD FOR CONDUCTING CORNER DEFORMATION ON CHAMFERED CONTINUOUS CASTING SLAB

FIELD OF THE INVENTION

The present invention relates to the field of metal solidification and continuous casting, in particular to a back-up roll device and method for conducting corner deformation on a chamfered continuous casting slab.

BACKGROUND OF THE INVENTION

With the development of world-wide metallurgy technology and advances of modern continuous casting technology, castable steel is continuously expanded, and some steel with high alloy, high quality and high crack sensitivity has been continuously produced by continuous casting process in large steel enterprise. However, in the production of plates and strips, a sliver or peeling-off defect at the edges of the hot rolled plates and strips is a common problem puzzling modern metallurgical workers all the time.

Particularly, with the recent development of continuous casting and rolling technology, energy is greatly saved caused by the slab hot charge directly to heating furnace. So, the continuous casting and rolling technology is widely applied to the production in metallurgy enterprises. However, the adverse effect brought by the continuous casting and rolling technology is all surface defects (including corner transverse cracks, longitudinal cracks and the like) of the casting slab are inevitably directly reflected on the surface of a final rolled strip because the casting slab can not be cleaned off line. It leads to the development and application of a chamfered mold technology.

By adopting the chamfered mold technology, each original right angle of the casting slab becomes two obtuse angles, to eliminate stress concentration in the bending and straightening process, so as to radically eliminate corner transverse cracks of the continuous casting slab. However, because the shape of the slab corners produced by a chamfered mold is limited, e.g. the angle of the chamfered casting slab is generally 25°-45° and the length of the chamfered surface is 30-85 mm, larger chamfer angle (e.g. more than 45°) of the casting slab produced by adopting the chamfered mold would bring two defects: 1) the service life of the chamfered mold is greatly shortened; and 2) the risk of breakout caused by slab off corner longitudinal cracks is increased. Therefore, the angle of the chamfered mold is less than 45° in the prior art.

Although the problem of transverse corner cracks of the casting slab may be effectively solved by adopting the chamfered mold technology, many production practice results show that edge slivers on plates and strips can not be completely eliminated by adopting the chamfered mold technology with above-mentioned parameters.

Thus, some foreign metallurgical researchers developed some methods for rolling casting slab corners, to obtain more reasonable slab corner shapes.

For example, Japanese patent No. P2001-18040A titled 'Production Method of Continuous Casting Slab' providing a device equipped with squeezing and rolling back-up rolls at four corners of a casting slab right below the mold, wherein a rectangular casting slab comes out from the mold and having four corners is squeezed and rolled into a casting slab with eight corners. Thus, corner defects of the casting slab in the following rolling process are avoided. In practical production, the casting slab which has a relatively thin slab shell and filled with molten steel is rolled at the outlet of the mold, so that the corners of the casting slab are deformed, each right angle is rolled to be flat and becomes two obtuse angles larger than 90°, and this is completely infeasible and also very dangerous.

To avoid a breakout risk caused by rolling the corners of the slab shell below the outlet of the mold, in Japanese patent No. S63-215352 titled 'Continuous Casting device', rolls for rolling corners of a casting slab are arranged on straightening machine in caster roll arrangement. Although this method may avoid the breakout risk caused by rolling the corners of the casting slab, in a modern slab continuous casting machine, the straightening machine is arranged into caster segment, and rolls for rolling the four corners of the casting slab at large rolling reduction and a driving device may not be arranged at all in the compact structural design. In addition, because the transverse corner cracks on slab is inevitable, the slab transverse corner cracks become defects on the surface of a rolled product by adopting such rolling method, and the defect only can be cleaned by trimming. Therefore, the yield is greatly reduced.

In Japanese patent No. H6-320204 titled 'Rolling Mill for Chamfering and Method for Chamfering Corners of Continuous Casting Slab', a dedicated rolling mill is arranged at the rear part of a continuous casting machine which roll a rectangular continuous casting slab, so that the corners of the rectangular continuous casting slab become large chamfers, to eliminate the slivers on a plate in the following rolling process. This method has two shortcomings: 1) the equipment investment is expensive because the slab corners need large deformation, and 2) as mentioned above, the slab transverse corner cracks are inevitable, and the slab transverse corner cracks will become defects on the surface of the rolled product by adopting such rolling method, so that the yield is greatly reduced.

SUMMARY OF THE INVENTION

In response to these shortcomings and defects in the prior art, the aim of the present invention is to provide a back-up roll device and method for conducting corner deformation on a chamfered continuous casting slab, for optimizing the corner shape of the casting slab and eliminating edge slivers of a plate under the condition that transverse corner cracks are completely controlled and eliminated.

For achieving the above purposes, the present invention provides the following technical solutions.

In a back-up roll device for conducting corner deformation on a chamfered continuous casting slab, the chamfered continuous casting slab is provided with two to four original chamfered bevels 11, and each original chamfered bevel 11 has an obtuse angle 7 on the wide face of the continuous casting slab, wherein the back-up roll device includes back-up rolls 1 with α-angle bevels, movable bearing seats 2, bearing seat moving rails 3, bearing seat motion holding mechanisms 4, and inner arc or outer arc frames 5 of a casting machine; and the back-up rolls 1 with α-angle bevels are arranged on the inner arc and/or outer arc frames 5 of the horizontal segment of the casting machine, and support surfaces of the back-up rolls 1 with α-angle bevels make contact with and squeeze obtuse angles 7 adjacent to the wide face of the inner or outer arc on the chamfered continuous casting slab 6, so that each obtuse angle 7 is squeezed into two larger obtuse angles 8-1 and 8-2.

The corner deformation completed by squeezing the continuous casting slab with the back-up roll device is each original chamfered bevel 11 is squeezed into two chamfered bevels 12-1 and 12-2, and the total length of L1+L2 of the two squeezed chamfered bevels is longer than the length S of the original chamfered bevel 11.

The angles α formed between the support surfaces of the back-up rolls 1 with α-angle bevels and the horizontal plane (or the wide face of the casting slab) are 15°-30°.

The thickness of the chamfered continuous casting slab 6 is 130-450 mm, the original chamfer angle β is 25°-45°, and the length S of the original chamfered bevel is 30-85 mm, and the length L2 of the squeezed chamfered bevel 12-2 is 10-50 mm, and the height H is 3-25 mm.

The support surfaces of the back-up rolls 1 with α-angle bevels are selected from one of the following conditions:

a: bevels; b: curved surfaces; c: bevels and a plane; d: curved surfaces and a plane;

in the conditions c and d, the height of the plane parts 10 of the support surfaces are kept consistent with that of the supporting plane of the casting slab supported by the inner arc or outer arc of a roll arrangement of the casting machine.

The bearing seat motion holding mechanisms 4, which are used for holding and moving the bearing seats, have a structure of hydraulically driving a piston rod or a structure of electrically driving a lead screw to rotate.

Displacement sensors for measuring the working positions of the back-up rolls 1 with α-angle bevels are arranged in the holding mechanisms 4 for moving the bearing seats.

The bearing seat moving rails 3 for moving the movable bearing seats 2 are square or dovetailed.

The back-up rolls 1 with α-angle bevels are arranged on the position of the last back-up roll of the last horizontal segment of the casting machine, or hung over the outlet of the horizontal segment, or arranged on the position of any back-up roll of any horizontal segment.

The back-up rolls 1 with α-angle bevels are arranged on the inner arc and/or outer arc frames 5 of the horizontal segment of the casting machine, and the support surfaces of the back-up rolls 1 with α-angle bevels make contact with and squeeze smaller obtuse angles 7 adjacent to the wide face of the inner or outer arc on the chamfered continuous casting slab 6, so that each smaller obtuse angle 7 is squeezed into two larger obtuse angles 8-1 and 8-2.

The corner deformation completed by squeezing the continuous casting slab with the back-up roll device is: each original chamfered bevel 11 is squeezed into two chamfered bevels 12-1 and 12-2, and the total length of L1+L2 of the two squeezed chamfered bevels is longer than the length S of the original chamfered bevel 11.

The beneficial effects of the present invention areas are as follows:

The continuous casting slab produced by adopting the chamfered mold technology may eliminate stress concentration during bending and straightening process, so as to radically eliminate slab transverse corner cracks. On this basis, the chamfers where the chamfered continuous casting slab is connected with the top and bottom wide faces are supported by the back-up rolls with bevels, the slab corners are squeezed in the supporting process to produce natural deformation, and although the deformation is very small, each original smaller obtuse angle becomes two larger obtuse angles, so that the temperature of the corners in the rolling process is effectively improved, and the purposes of optimizing the corner shape of the casting slab and eliminating the edge slivers of the plate may be achieved under the condition that the transverse corner cracks are completely controlled and eliminated.

Compared with the prior art, the corner deformation is small and the defect of transverse corner cracks of the casting slab does not exist, so that the device and the method of the present invention have the advantages of technical reliability, processing simplicity, light weight of equipment and the like and do not produce any negative effect on the production of the continuous casting machine.

MAIN REFERENCES IN DRAWINGS

Figure 1:
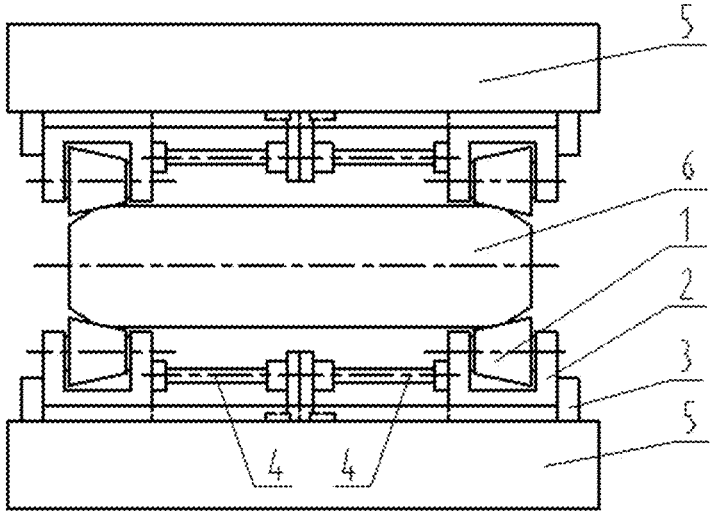
FIG. 1 is a schematic diagram of a back-up roll device for conducting corner deformation on a chamfered continuous casting slab.

1 back-up roll with α-angle bevel
2 movable bearing seat
3 bearing seat moving rail
4 bearing seat motion holding mechanism
5 inner or outer arc frame of horizontal segment of casting machine
6 chamfered continuous casting slab
7 smaller obtuse angle adjacent to the wide face of an inner or outer arc on the chamfered continuous casting slab
8-1, 8-2 two larger obtuse angles naturally squeezed from a smaller obtuse angle
9 conventional back-up roll of the horizontal segment of the casting machine
10 plane part of support surface of back-up roll with α-angle bevel
11 original chamfered bevel

12-1, 12-2 two squeezed chamfered bevels

α angles between the support surfaces of back-up rolls 1 with α-angle bevels and the horizontal plane β original angle of chamfered continuous casting slab S length of original chamfered bevel of chamfered continuous casting slab L1, L2 lengths of squeezed chamfered bevels of chamfered continuous casting slab H height of squeezed bevel of chamfered continuous casting slab

DETAILED DESCRIPTION OF THE EMBODIMENTS

Specific embodiments of the present invention will be further described as follows according to the accompanying drawings.

FIG. 1 shows a back-up roll device for conducting corner deformation on a chamfered continuous casting slab. The back-up roll device mainly includes back-up rolls 1 with α-angle bevels, movable bearing seats 2, bearing seat moving rails 3, bearing seat motion holding mechanisms 4, and inner arc or outer arc frames 5 of a casting machine. Wherein, a pair of symmetrical back-up rolls 1 with α-angle bevels is arranged on the movable bearing seats 2, the bearing seat moving rails 3 are arranged below the movable bearing seats 2, the bearing seat moving rails 3 are arranged on the inner arc or outer arc frames 5 of the horizontal segment of the casting machine, the bearing seat motion holding mechanisms 4 are connected with the movable bearing seats 2, and the movable bearing seats 2 are moved and positioned through the bearing seat motion holding mechanisms 4.

Figure 3:
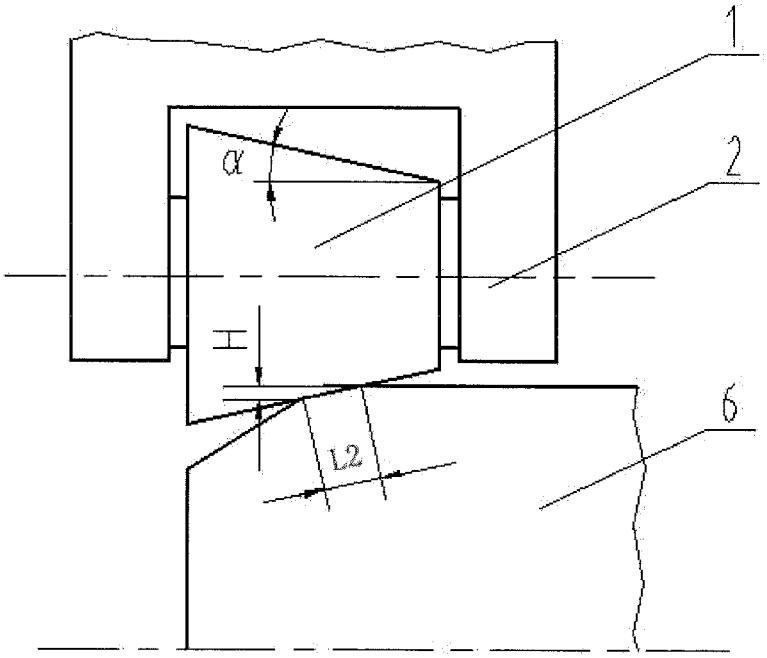
FIG. 3 is a partial enlarged schematic diagram of conducting corner deformation on the chamfered continuous casting slab.

Wherein, the angles α formed between the support surfaces of the back-up rolls 1 with α-angle bevels and the horizontal plane are 15°-30°. The support surfaces make contact with and squeeze smaller obtuse angles 7 adjacent to the wide face of the inner or outer arc on the chamfered continuous casting slab 6, so that each smaller obtuse angle 7 adjacent to the wide face of the inner arc or outer arc is squeezed into two larger obtuse angles 8-1 and 8-2, the length L2 of the squeezed bevels is 10-50 mm, and the height H is 3-25 mm. FIG. 3 shows a partial enlarged schematic diagram of conducting corner deformation on the chamfered continuous casting slab.

Figure 6A:
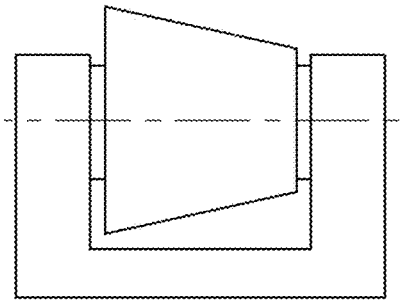
FIG. 6*a* is a schematic diagram showing that the support surface of a back-up roll with α-angle bevel is a bevel.
Figure 6B:
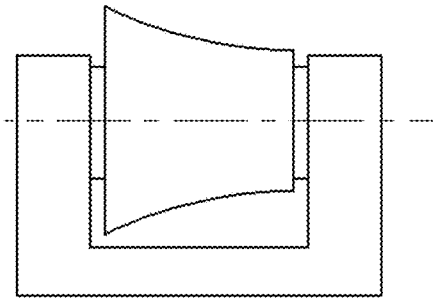
FIG. 6*b* is a schematic diagram showing that the support surface of a back-up roll with α-angle bevel is a curved surface.
Figure 6C:
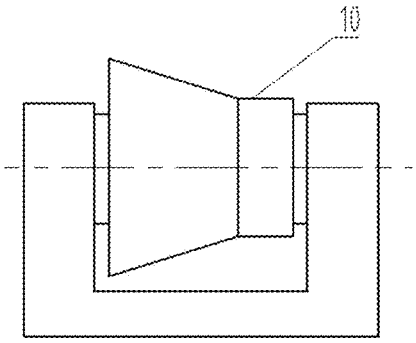
FIG. 6*c* is a schematic diagram showing that the support surface of a back-up roll with α-angle bevel is a bevel and a plane.
Figure 6D:
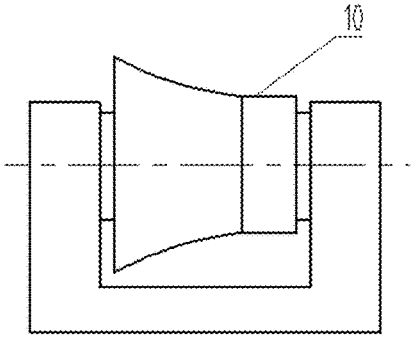
FIG. 6*d* is a schematic diagram showing that the support surface of a back-up roll with α-angle bevel is a curved surface and a plane.

The support surfaces of the back-up rolls 1 with α-angle bevels may be bevels as shown in FIG. 6*a*, curved surfaces as shown in FIG. 6*b*, a combination of bevels and a plane as shown in FIG. 6*c* or a combination of curved surfaces and a plane as shown in FIG. 6*d*. Wherein, under the conditions of FIG. 6*c* and FIG. 6*d*, the height of the plane parts 10 of the support surfaces of the back-up rolls 1 with α-angle bevels are kept consistent with that of the supporting plane of the casting slab supported by the inner arc or outer arc of a roll arrangement of the casting machine.

Figure 4:
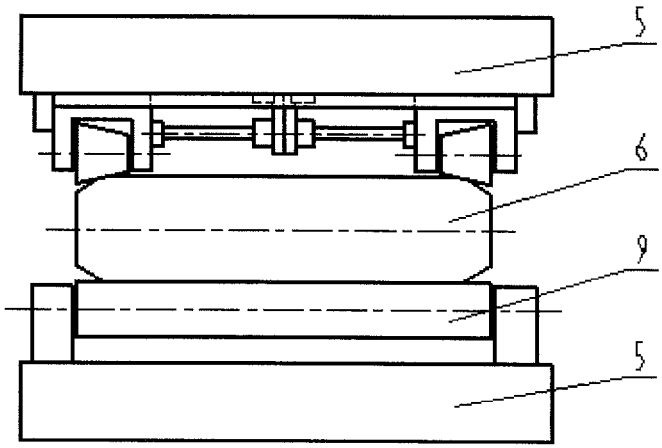
FIG. 4 is a schematic diagram showing that back-up rolls with α-angle bevels are only arranged on the inner arc of a casting machine.
Figure 5:
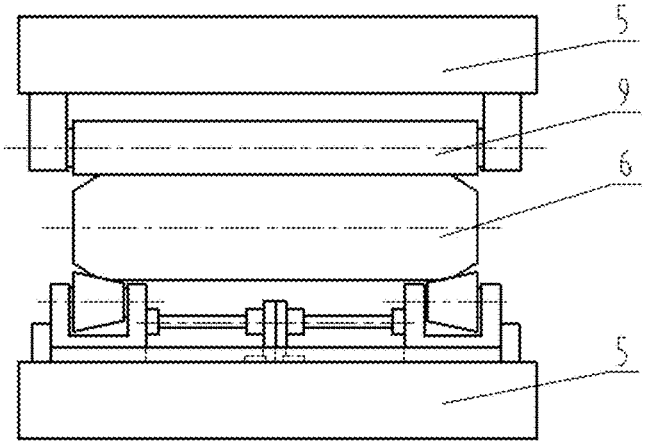
FIG. 5 is a schematic diagram showing that the back-up rolls with α-angle bevels are only arranged on the outer arc of the casting machine.

The back-up rolls 1 with α-angle bevels may be simultaneously arranged on the inner arc and the outer arc of the casting machine, or only arranged on the inner arc or the outer arc of the casting machine. FIG. 4 and FIG. 5 respectively show a schematic diagram showing that back-up rolls with α-angle bevels are only arranged on the inner arc of the casting machine and a schematic diagram showing that the back-up rolls with α-angle bevels are only arranged on the outer arc of the casting machine.

The bearing seat motion holding mechanisms 4 for holding and moving the bearing seats may have a structure of hydraulically driving a piston rod or a structure of electrically driving a lead screw to rotate.

Figure 7A:
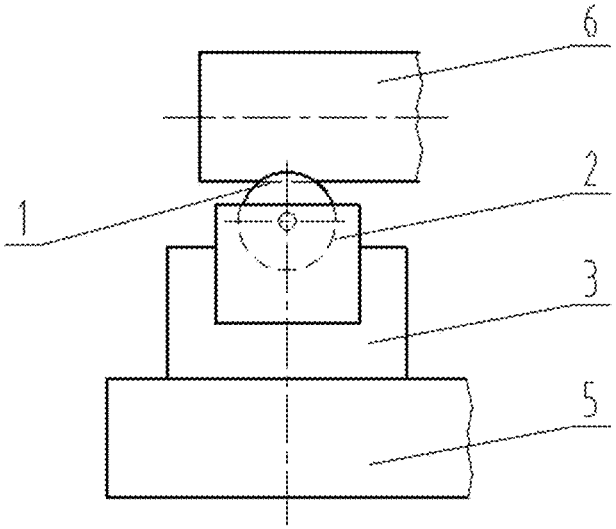
FIG. 7*a* is a schematic diagram showing that a bearing seat moving rail is square.
Figure 7B:
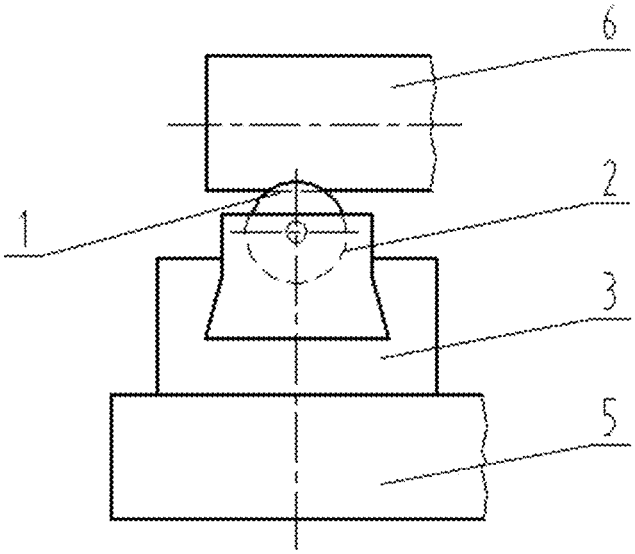
FIG. 7*b* is a schematic diagram showing that a bearing seat moving rail is dovetailed.

The bearing seat moving rails 3 for moving the movable bearing seats 2 may be square as shown in FIG. 7*a*, or dovetailed as shown in FIG. 7*b*.

Figure 8:
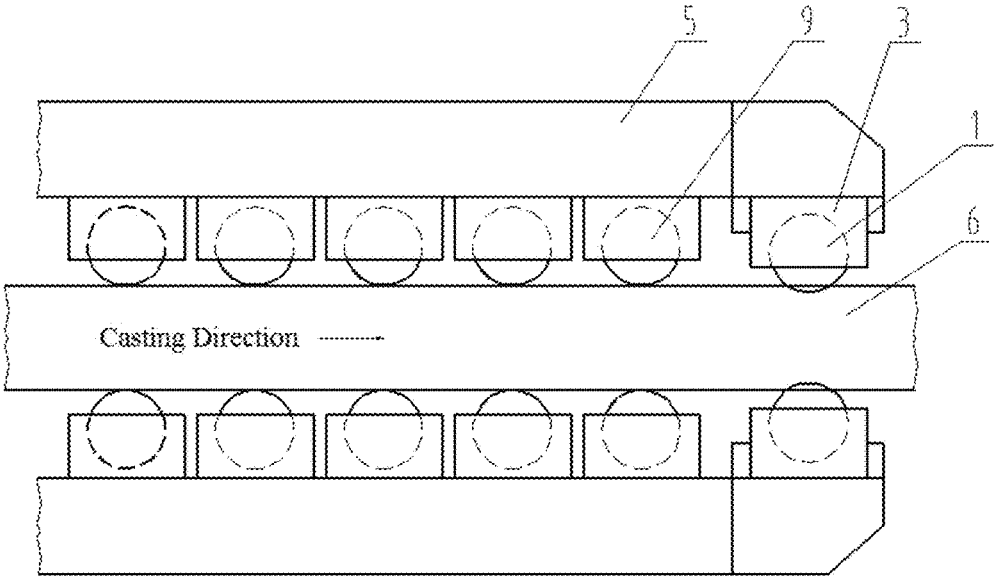
FIG. 8 is a schematic diagram showing that the back-up rolls with α-angle bevels are hung over the outlet of a horizontal segment.

The back-up rolls 1 with α-angle bevels are arranged on the position of the last back-up roll of the last horizontal segment of the casting machine as shown in FIG. 1, or hung over the outlet of the horizontal segment as shown in FIG. 8, or arranged on the position of any back-up roll of any horizontal segment and combined with a conventional back-up roll 9 of the horizontal segment of the casting machine.

In the back-up roll device for conducting corner deformation on the chamfered continuous casting slab, the thickness of the chamfered continuous casting slab is 130-450 mm, the original chamfer angle β is 25°-45°, and the length S of the original chamfered bevel is 30-85 mm.

When the back-up roll device is used, the back-up rolls 1 with α-angle bevels are arranged on the inner arc and/or outer arc frames 5 of the horizontal segment of the casting machine. Displacement sensors are arranged in the holding mechanisms 4 for moving the bearing seats, and the displacement sensors may be used for measuring the working positions of the back-up rolls 1 with α-angle bevels. According to the width of the cross section of the continuous casting slab, the positions of the movable bearing seats 2 are adjusted through the bearing seat motion holding mechanisms 4, and then the positions of the back-up rolls 1 with α-angle bevels are adjusted, so that the bevels of the back-up rolls are just supported on the corners of the four smaller obtuse angles 7 adjacent to the wide face of the inner or outer arc on the chamfered continuous casting slab 6.

Figure 2A:
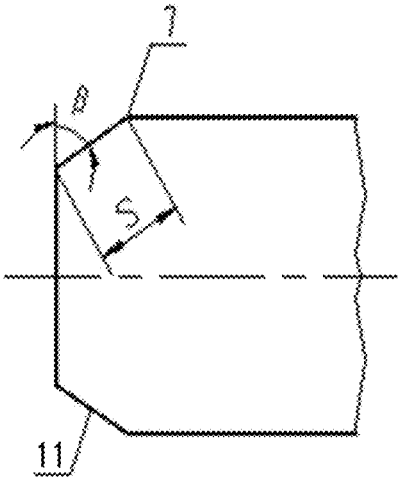
FIG. 2*a* is a partial enlarged schematic diagram before a corner of the chamfered continuous casting slab is deformed.
Figure 2B:
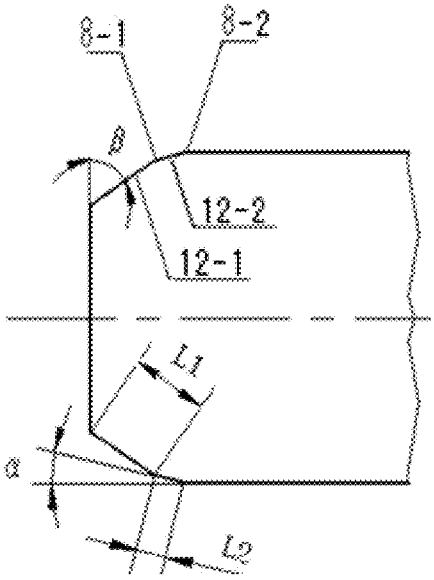
FIG. 2*b* is a partial enlarged schematic diagram after a corner of the chamfered continuous casting slab is deformed.

Thus, along with the drawing process, each smaller obtuse angle 7 is naturally squeezed into two larger obtuse angles 8-1 and 8-2. FIG. 2*a* shows a partial enlarged schematic diagram before a corner of the chamfered continuous casting slab is deformed, and FIG. 2*b* shows a partial enlarged schematic diagram after a corner of the chamfered continuous casting slab is deformed. The continuous casting slab in such corner shape may achieve the purposes of optimizing the corner shape of the casting slab and eliminating edge slivers of a plate under the condition that the transverse corner cracks are completely controlled and eliminated.

The invention claimed is:

1. A back-up roll device for conducting corner deformation on a chamfered continuous casting slab, wherein the chamfered continuous casting slab is provided with two to four original chamfered bevels, and each original chamfered bevel has an obtuse angle on a wide face of the continuous casting slab, wherein, the back-up roll device comprises back-up rolls with α-angle bevels, movable bearing seats, bearing seat moving rails, bearing seat motion holding mechanisms, and inner arc or outer arc frames of a casting machine;

the back-up rolls with α-angle bevels are arranged on the inner arc and/or outer arc frames of a horizontal segment of the casting machine, and support surfaces of the back-up rolls with α-angle bevels make contact with and squeeze obtuse angles adjacent to the wide face of the inner or outer arc on the chamfered continuous casting slab, so that each obtuse angle is squeezed into two larger obtuse angles;

displacement sensors for measuring working positions of the back-up rolls with α-angle bevels are arranged in the holding mechanisms for moving the bearing seats.

2. The back-up roll device for conducting corner deformation on the chamfered continuous casting slab of claim 1, wherein the corner deformation completed by squeezing the continuous casting slab with the back-up roll device is: each original chamfered bevel is squeezed into two chamfered bevels, and a total length of L1+L2 of the two squeezed chamfered bevels is longer than a length S of the original chamfered bevel.

3. The back-up roll device for conducting corner deformation on the chamfered continuous casting slab of claim 1, wherein the angles α formed between the support surfaces of the back-up rolls with α-angle bevels and a horizontal plane (or the wide face of the casting slab) are 15°-30°.

4. The back-up roll device for conducting corner deformation on the chamfered continuous casting slab of claim 1, wherein a thickness of the chamfered continuous casting slab is 130-450 mm, an original chamfer angle β is 25°-45°, and a length S of the original chamfered bevel is 30-85 mm; and a length L2 of the squeezed chamfered bevel is 10-50 mm, and a height H is 3-25 mm.

5. The back-up roll device for conducting corner deformation on the chamfered continuous casting slab of claim 1, wherein the support surfaces of the back-up rolls with α-angle bevels are selected from one of the following conditions:

a, bevels; b, curved surfaces; c, bevels and a plane; d, curved surfaces and a plane;

in the conditions c and d, the height of plane parts of the support surfaces are kept consistent with that of a supporting plane of the casting slab supported by an inner arc or outer arc of a roll arrangement of the casting machine.

6. The back-up roll device for conducting corner deformation on the chamfered continuous casting slab of claim 1, wherein the bearing seat motion holding mechanisms, which are used for holding and moving the bearing seats, have a structure of hydraulically driving a piston rod or a structure of electrically driving a lead screw to rotate.

7. The back-up roll device for conducting corner deformation on the chamfered continuous casting slab of claim 1, wherein the bearing seat moving rails for moving the movable bearing seats are square or dovetailed.

8. The back-up roll device for conducting corner deformation on the chamfered continuous casting slab of claim 1, wherein the back-up rolls with α-angle bevels are arranged on the position of a last back-up roll of a last horizontal segment of the casting machine, or hung over an outlet of a horizontal segment, or arranged on the position of any back-up roll of any horizontal segment.

* * * * *